United States Patent [19]

West et al.

[11] Patent Number: 4,518,153

[45] Date of Patent: May 21, 1985

[54] SAFETY MECHANISM FOR HOISTING DRUMS

[75] Inventors: Harold H. West, King County; Roger A. Johnson, Snohomish County; Charles W. Clark, Jr., King County, all of Wash.

[73] Assignee: Ederer Incorporated, Seattle, Wash.

[21] Appl. No.: 624,918

[22] Filed: Jun. 27, 1984

Related U.S. Application Data

[63] Continuation of Ser. No. 317,054, Nov. 2, 1981, abandoned.

[51] Int. Cl.[3] ..... B66D 1/48; B66D 1/54; B66D 5/20

[52] U.S. Cl. ..... 254/274; 74/423; 188/166; 188/170; 254/342; 254/378

[58] Field of Search ..... 254/274, 275, 276, 375, 254/378; 192/17 C, 2; 188/166, 170; 74/423

[56] References Cited

U.S. PATENT DOCUMENTS

| | | | |
|---|---|---|---|
| 2,250,985 | 7/1941 | Benson | 254/275 |
| 2,356,762 | 8/1944 | Kalix | 254/267 |
| 2,950,086 | 8/1960 | Abraham | 254/274 |
| 3,102,434 | 9/1963 | Cramer, Jr. | 254/267 |
| 3,753,552 | 9/1973 | Barron | 254/275 |
| 3,917,230 | 11/1975 | Barron | 254/274 |
| 4,023,655 | 5/1977 | Anzai et al. | 188/171 |
| 4,175,727 | 11/1979 | Clarke | 254/274 |
| 4,177,973 | 12/1979 | Miller | 254/276 |

*Primary Examiner*—Billy S. Taylor

*Attorney, Agent, or Firm*—Seed and Berry

[57] ABSTRACT

The safety system in a hoist having a motor with a motor shaft, a gear reduction unit, a drum, a safety brake drivingly coupled on an operating element on or close to the drum in which a mechanical out-of-sync detector produces a unidirectional brake-setting output from inputs from the drum and the motor shaft, the unidirectional brake-setting rotational output for setting the brake. In a preferred embodiment, an error correction is made into the detector for obtaining a first unidirectional output during normal operation, and the brake-setting unidirectional rotation is in the opposite direction for setting the brake. One form of detector is a mechanical differential assembly and another form of detector is a set of coaxial shafts that measure differential rotation between the drum and motor input shafts. A unique brake actuator is provided and is easily reset remotely after the brake has been set.

27 Claims, 9 Drawing Figures

FIG. 2
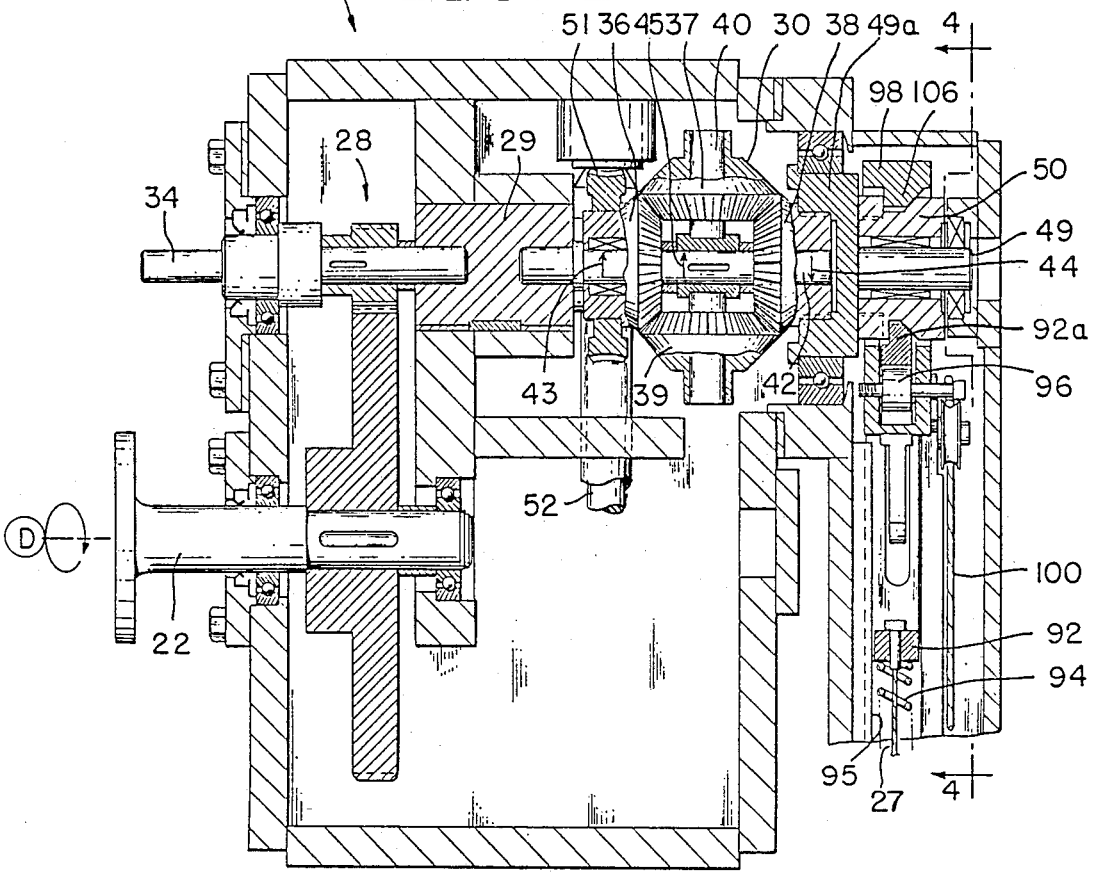
FIG. 3
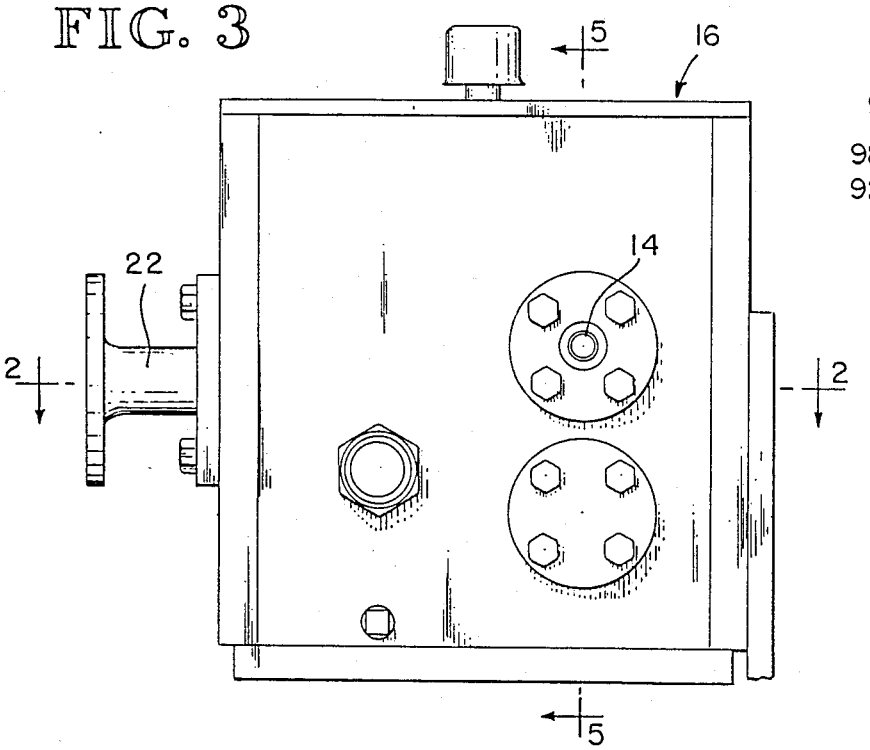
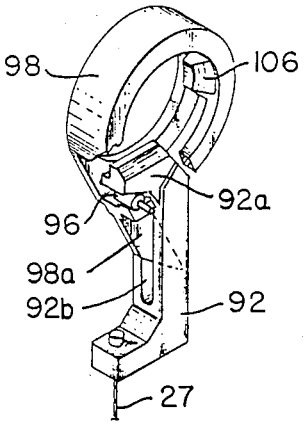
FIG. 2A

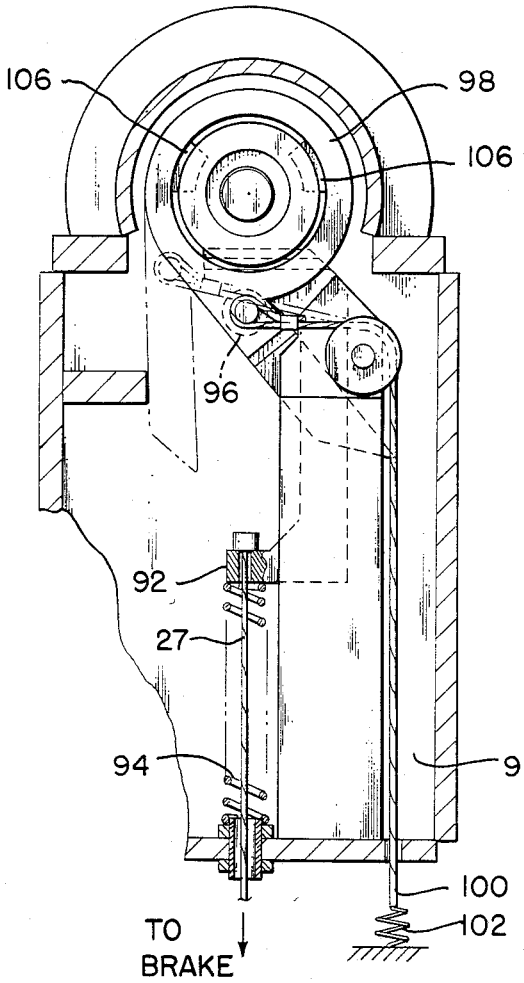
FIG. 4
FIG. 5
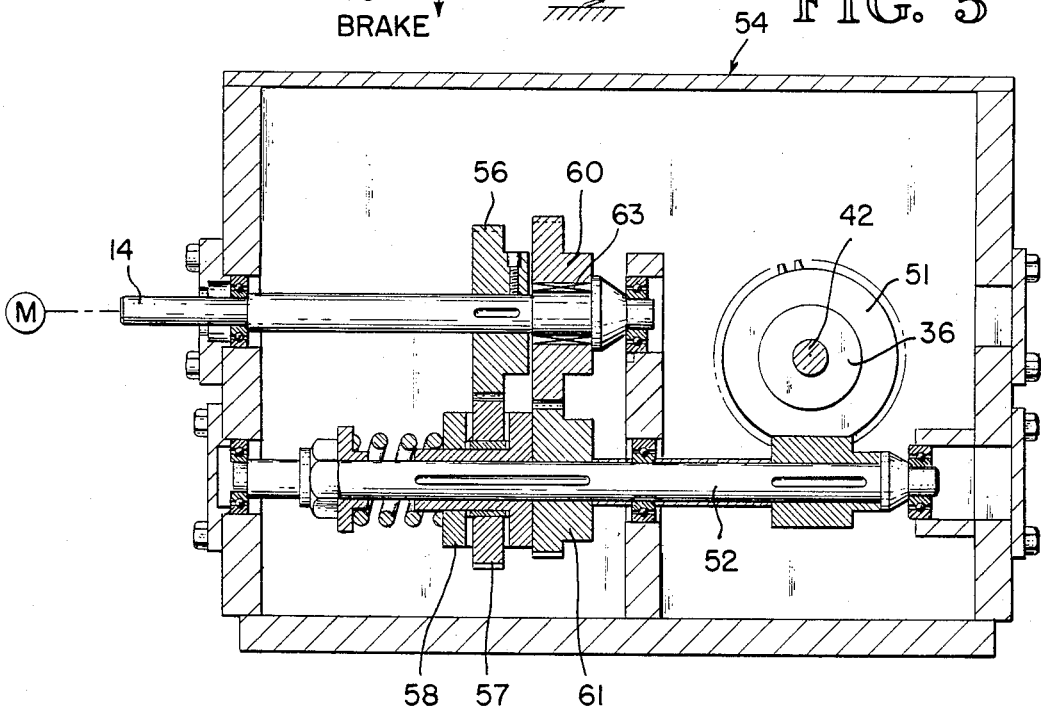

SAFETY MECHANISM FOR HOISTING DRUMS

This application is a continuation of U.S. patent application Ser. No. 317,054, filed Nov. 2, 1981, now abandoned under C.F.R. §1.62.

DESCRIPTION

1. Technical Field

This invention pertains to hoisting equipment and, more particularly, to safety systems for such hoisting equipment.

2. Background Art

U.S. Pat. Nos. 4,175,727 and 4,177,973 are directed to safety systems for automatically setting a drum brake or other type of emergency holding device directly on the drum or on a shaft drivingly connected with the drum and in close proximity to the drum so that the system makes the hoist essentially single-failure-proof. This means that should a failure occur in any location in the input drive or should there be a load hang-up or two-blocking condition, this hazard or failure would immediately be detected and the brake set. This type of system is intended to serve as a substitute for the conventional redundant drive systems utilized for safety in cranes.

U.S. Pat. No. 4,177,973 discloses, inter alia, detecting when the drum and motor are no longer running in a predetermined synchronous condition and uses this out-of-sync determination to set the safety brake. Commonly assigned U.S. patent application Ser. No. 205,009, filed Nov. 7, 1980, and now abandoned, is directed to additional improved embodiments of the failure detection and brake-setting concept of U.S. Pat. Nos. 4,175,727 and 4,177,973. This patent application discloses the use of a unique differential concept for detecting the out-of-sync condition and producing a signal for setting the safety brake. Another important concept disclosed in application Ser. No. 205,009 is the use of a hoist safety brake-setting technique in which a small force can hold a large brake-setting force in a cocked or ready condition, and then, by release of this small force, the large force can be applied to set the safety brake.

The purpose of all of these safety system concepts is to enable an instantaneous application of a large-capacity safety brake to be applied to the drum or on the element closely drivingly coupled to the drum so that the brake can be set in the event of a failure or hazard condition or by remote command and brought to rest quickly before it has accelerated to an uncontrollable speed.

DISCLOSURE OF INVENTION

This invention is directed to additional improved concepts relating to such safety systems as are described in said earlier patents and pending patent application. Thus it is an object of this invention to provide an improved method and apparatus for detecting a failure or other hazard in a hoisting device and setting a safety brake in response thereto.

It is another object of this invention to provide a mechanical detector which produces a unidirectional output under normal conditions but produces an opposite directional output in a failure or hazard condition to set the brake.

It is another object of this invention to provide an improved brake-setting apparatus responsive to a failure or hazard condition sensed by a detector.

It is still another object to provide a method and apparatus for correcting for internal slippage in a hoisting system of the type in which an energy absorption device which would cause slippage between the motor and the drum is an integral part of the drive system for the drum. The purpose of this object is to avoid inadvertent or "nuisance" trips or settings of the safety brake due to the inherent slippage of the energy absorption device.

It is still another object of the preferred embodiment to monitor the rotational velocities of the motor shaft and drum and to produce a predetermined unidirectional output rotation from a detector and to change the direction of such predetermined unidirectional output upon the occurrence of a failure or a hazard condition which changed the relative velocities and/or directions between the motor shaft and drum.

Basically, these objects are obtained in their broadest sense by providing a mechanical detector which monitors the differential between the input velocities of the drum and motor to produce a known or predetermined unidirectional output rotation from such detector. Upon a hazard or failure condition, one of the input velocities will be affected to change the differential input velocities from the drum and motor and, in response thereto, change the unidirectional output rotation to the opposite direction. This opposite direction of the output rotation then preferably mechanically releases the safety brake to bring the drum to a halt. In one embodiment, this detector is a differential assembly in which input shafts from the drum and motor provide the input, with the differential assembly having an output shaft whose direction will either be unidirectional or have a zero velocity during normal operating conditions, but which will rotate in one direction (opposite to said normal direction) upon a failure or hazard condition. In another embodiment, the inputs are two coaxially aligned rotational members which produce either a zero velocity output or a known unidirectional rotational output. With a failure or hazard condition, the inputs to one of the coaxial members will be varied and produce an output from zero velocity in a desired rotational direction or, where the output was unidirectional, will change the direction of rotation of the output to the opposite direction. This desired or opposite directional rotation is then detected and sets the brake.

In any of the above embodiments, a slip correction device can be added which will produce a continuous, predetermined, unidirectional differential output from the detector in excess of any differential movement between the drum and motor shaft caused by slippage. With such a slip correction device, a failure or hazard condition will vary the inputs such that the direction of the output will always go to the opposite direction to set the brake.

In a preferred embodiment, the brake is set by a triggering device similar to that shown in patent application Ser. No. 205,009, but other brake-setting techniques may be employed.

An advantage of these embodiments which produce a zero or unidirectional output under normal operating conditions is that it allows the operational condition between the motor shaft and drum to be visually monitored; and, after the occurrence of a failure or hazard, which produces a desired directional output to set the brake, the cause of the failure or hazard is more easily traced. Resetting of the brake is also advantageously achieved. The detector in the preferred embodiment will detect overspeed as well as other failure conditions.

In a preferred embodiment, the brake would normally be set by using a low-speed, high-force reset mechanism, such as air cylinders or electric worm drives, for example, to cock a high-force spring. The high-force spring will be retained in a cocked position by a triggering mechanism which is controlled by a relatively low force. It is an advantage of the preferred embodiments that the resetting of the spring and trigger mechanism can be controlled remotely by an operator and, also advantageously, the trigger can be released and the brake set also remotely by an operator.

The apparatus of the preferred embodiments is relatively inexpensive to manufacture and is essentially single-failure-proof. That is, the detector will produce a desired brake-setting output in the event of any failure in the drive train between the motor and the drum, a two-blocking or load hang-up condition, and, if desired, an overspeed condition of the type in which the motor controller may erroneously signal the drum to be driven in a dangerous overspeed condition.

A further advantage is the elimination of nuisance trips, particularly if there is slippage in the drive between the motor and drum. If a unique energy absorption device of the type shown in U.S. Pat. No. 4,175,727 is employed in the drive train, slippage could occur. The energy absorption is intended to absorb the high-velocity kinetic energy of the drive train in the event of a failure. Since the energy absorption device normally will allow some relative slippage between the drum and motor, over a long operational span, this slippage could accumulate in any detector and must therefore be nulled out or otherwise compensated for.

When no slip correction device is provided, the differential relative velocities between the motor shaft and drum can be zero if equal speed reductions are employed to the detector between the drum and motor. If the speed reductions, although fixed, are different, there will be a known unidirectional output from the detector. When an energy absorption device is provided, there may be bidirectional slippage between the inputs to the detector from the drum and the motor; but with the slip correction device of this invention, these bidirectional differentials can be converted to a continuous, known unidirectional output of the detector.

It should also be understood that while a total system and variations thereof will be illustrated and described, various components themselves are unique and have utility apart from a total system.

BRIEF DESCRIPTION OF THE DRAWINGS

FIG. 2 is a schematic taken generally along the line 2—2 of FIG. 3 illustrating a differential assembly embodiment of the system shown in FIG. 1.

FIG. 2A is a fragmentary isometric of a portion of the system shown in FIG. 2.

FIG. 3 is a side elevation of a portion of the apparatus shown in FIG. 1.

FIG. 4 is a section taken generally along the line 4—4 of FIG. 2.

FIG. 5 is a section taken generally along the line 5—5 of FIG. 3 illustrating the slip correction device embodying the principles of the invention.

BEST MODE FOR CARRYING OUT THE INVENTION

Figures 1, 1A:
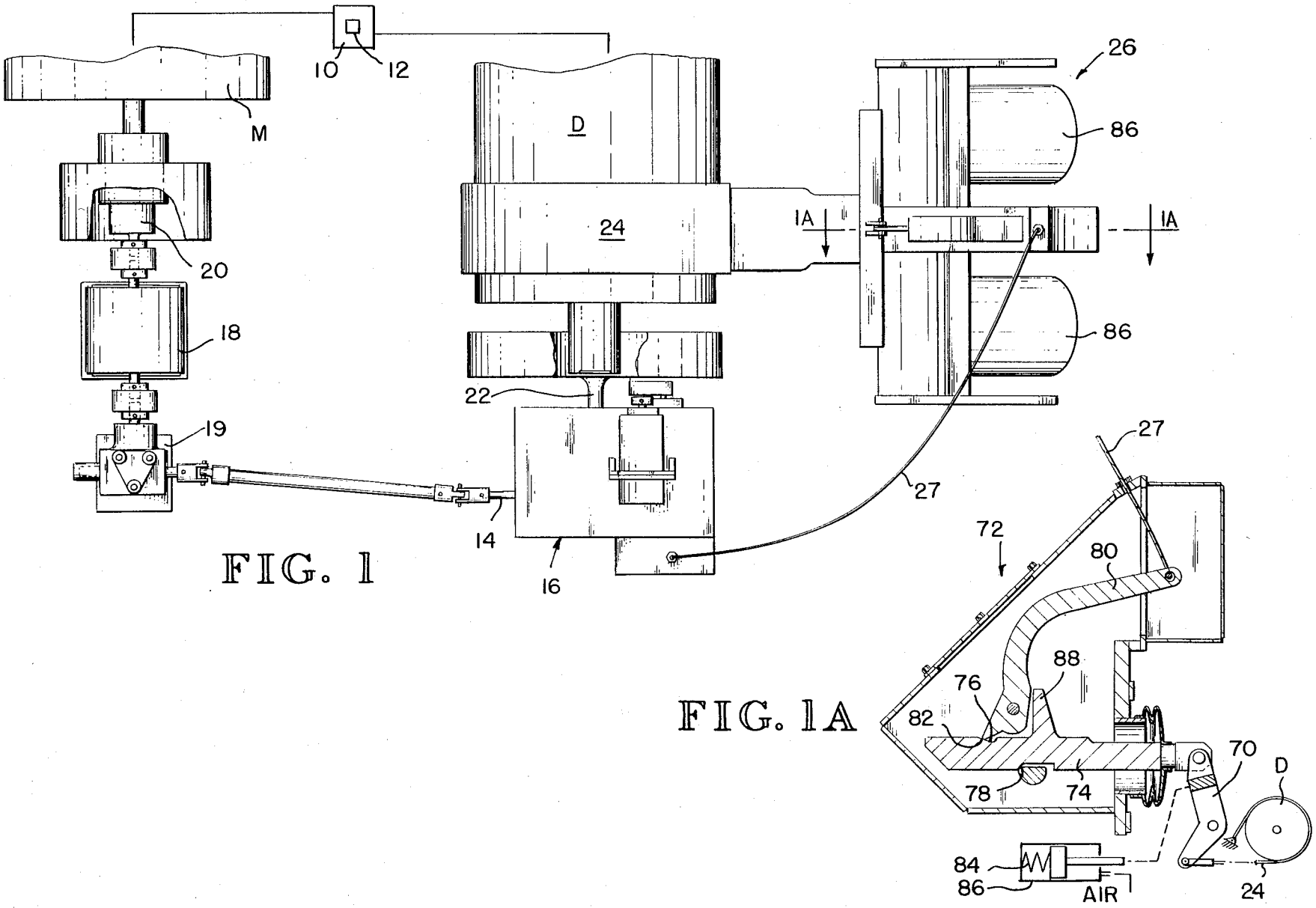
FIG. 1 is a schematic plan of a safety system embodying the principles of the invention.
FIG. 1A is a fragmentary enlarged section of a portion of a brake-setting trigger employed in the apparatus of FIG. 1.

As best shown in FIG. 1, a motor M is drivingly coupled to a drum D by a conventional power transmission main drive train including a gear reduction unit 10. In the preferred embodiment, the gear reduction unit is of the type shown in Patent 4,175,727 and includes a passive energy absorption device 12. The description of U.S. Pat. No. 4,175,727 is hereby incorporated by reference thereto.

The opposite end of the motor is connected through a secondary drive train to an input shaft 14 of an out-ofsync detector 16. In the embodiment of FIG. 1, the out-of-sycn detector is a mechanical differential assembly, as best shown in FIG. 2. The motor is joined to the input shaft 14 by an electric clutch 18 and conventional right-angle drive element 19. The motor M is provided with a conventional electrically controlled operational brake 20. In a preferred embodiment illustrated the brake 20 is known in the art as the last upstream or high speed load carrying component. This type of brake is generally set when electrically deenergized, i.e., in the absence of electricity. The electrical clutch 18 is employed between the motor and the motor input shaft 14 for overspeed protection. For this purpose, the clutch 18, which may be a conventional electric clutch, is drivingly coupled between the input shaft 14 and the motor when the electric motor is being energized, but becomes decoupled when the electricity is removed from the motor or during a total electrical blackout. The clutch also will become decoupled when the drum's rotational velocity exceeds a predetermined value, as in a hazard condition of the type in which the motor controller directs the motor to run at an unsafe overspeed condition. "Overspeed," as used herein, is a well known term in the art to signify a condition when, for the particular hoisting system, the motor is running at an excessive speed, for example, 150 and 200 percent of its normal operating speed. A suitable clutch is available from Warner Electric, Inc., of Beloit, Wis. Similar mechanically decoupled overspeed clutches are also suitable.

A second input shaft 22 to the detector 16 is from the drum D. The drum D in the preferred embodiment illustrated is known in the art as the last downstream or low speed load carrying component. As is also well known, neither the brake 20 nor the drum D in other embodiments need be the last high speed or last low speed load carrying component. The drum is also provided with a safety brake 24, which, preferably, is a conventional heavy-duty band brake but which may also be any other suitable brake, such as the caliper brake of the type shown in U.S. Pat. No. 4,175,727. The brake is set by a brake actuator 26 which receives a signal from the detector 16 of a failure or hazard condition, which signal is, in a preferred embodiment, transmitted via a mechanical cable 27.

The detector 16 is provided with a gear reduction 28 which couples the drum shaft 22 to a conventional differential gear assembly 30 via a NO-BAK coupling 29. NO-BAK clutching devices are essentially conventional clutches which will drivingly couple or transmit motion from the input shaft 22 into the differential 30 in either rotational direction, but will lock up and not transmit motion in the reverse direction, that is, from the differential assembly 30 back to the input shaft 22. The NO-BAK devices are described in more detail, as well as mechanical overspeed decoupling clutches, in said patent application Ser. No. 205,009, a description of which is incorporated herein by reference thereto.

The differential assembly 30 is of a conventional construction having a set of bevel gears 36-39 which are freely rotatable on spindles that are keyed to a housing 40. The housing is keyed to a spindle 42, whereas gears 36 and 38 are freely rotatable on spindle 42. As is well understood with differential assemblies, clockwise rotation in the direction of arrow 43 of the gear 36, with the housing held stationary, will result in counterclockwise rotation of gear 38 in the direction of arrow 44. As is also well understood, if the entire housing rotates in a clockwise direction, as shown by arrow 45, then gear 38 will rotate in a clockwise direction. (The rotational directions for purposes of this description will be viewed arbitrarily as looking in the direction of arrows 4—4 of FIG. 2, and also are arbitrarily shown as in the load lowering mode.)

Gear 38 is keyed to a hub 49*a* fixed to an output shaft 49 on which is mounted to a one-way sprag clutch 50. The shaft 49 will freewheel in the counterclockwise direction of rotation in the sprag clutch 50, but in the opposite direction will lock up with the clutch, causing rotation of the clutch.

As earlier stated, the input to the differential housing 40 is through the NO-BAK 29. NO-BAK coupler 29 is driven from the drum through the gear reduction 28. The second input to the differential assembly is through worm gear 51, driven by a screw shaft 52. Worm gear 57 is keyed to gear 36. Shaft 14 from motor M is connected to shaft 52 through a slip correction device 54 (FIG. 5). The slip correction device includes a first set of gears 56 and 57 having diametrical ratios which produce a slower rotational velocity in shaft 52 than is in shaft 14. Gear 57 is coupled to shaft 52 through a friction slip clutch 58. A second set of gears 60 and 61 result in a rotational velocity of shaft 52 which is greater than the rotational velocity of shaft 14. Gear 60 is coupled to shaft 14 through a one-way sprag clutch 63. The result of this gearing and clutching arrangement is that when shaft 14 is turning counterclockwise (looking left in FIG. 5), for example, the drive will be through gears 56 and 57 to reduce the velocity of shaft 52. Gear 60 will freewheel on shaft 14. When shaft 14 is rotated clockwise, sprag clutch 63 locks gear 60, resulting in shaft 52 being rotated at a higher velocity than shaft 14, with gear 57 slipping in clutch 58. The purpose of this slip correction device is to provide an input direction and velocity to the differential 30 which are different than those from the input from the NO-BAK 29 from the drum (assuming that the gear reductions between the drum and its differential input and the motor and the differential input through gear 51 are at or about the same reductions) such that gear 38 will always result in a net unidirectional rotational output in the counterclockwise direction. If there was no slip correction device and the gear reductions between the drum and motor to the differential assembly were identical, then the gear 38 would be stationary under normal operating conditions. With the slip correction device, the counterclockwise component added to the gear 38 allows the output shaft 49 to rotate in a freewheeling condition; and should limited slip occur between the motor and the drum due to a passive energy absorption device, such as device 12, then the slip will be less than that required to trip the brake and the added component of velocity added to the gear 38 and will null out the slip during operation of the hoist. As is readily apparent the slip correction device produces differential rotation into the differential assembly 30 or differential deflector of FIG. 6 that is opposite and of greater velocity than the input rotations that would cause an output rotation which causes the brake to be engaged.

As a further example, assume that the motor is rotated in a direction to rotate the drum in a raising mode. For this description, assume that when raising, shaft 52 will be made to turn slower than shaft 14. Also assume the teeth angles between screw 52 and gear 51 are such that the input to the differential through worm gear 51 will be faster but in the same direction as the input to the differential through NO-BAK 29. Assume these directions are counterclockwise. The net output will result in rotation of shaft 49 in the counterclockwise direction.

Whe lowering the load, sprag clutch 63 becomes engaged and shaft 52 is rotated at a greater speed than shaft 14. This results in an input from worm gear 51 to the differential assembly, which is greater than the input from NO-BAK 29. Since the direction of rotation of NO-BAK 29 is now in the opposite or clockwise direction, as shown by arrow 43, however, the net result will again produce an output rotation of shaft 49 again in the counterclockwise, freewheeling direction.

This unidirectional freewheeling rotation of output shaft 49 is uniquely employed with limited slip operation. With the absence of a passive energy absorption device, the shaft will be at zero velocity. The important point, however, is that the sprag clutch 50 will produce a rotational output whenever the direction of shaft 49 is in the clockwise direction, either from zero velocity, where there is no slip correction, or from a counterclockwise direction, where there is slip correction. This output is used to signal the hazard or failure condition to set the brake.

Various examples of the operation for detection of a hazard or failure will now be given. As a first example, consider the drive between the motor and the drum via gear reduction 10 is broken while the drum is being rotated in a raising mode. The drum will immediately reverse to a lowering mode, which will reverse the direction of the NO-BAK 29 but will not reverse the motor input direction. This will reverse the direction of the housing 40, immediately causing a clockwise rotational direction to shaft 49 to produce a brake-set signal.

As a second example, consider two-blocking or load hang-up while the load is being raised. In this mode, the drum stops rotating; this stops rotation of the differential housing 40. During normal operation in the raising direction, worm gear 51 was being rotated counterclockwise at a speed slower than the housing 40, resulting in a net counterclockwise rotation of shaft 49. However, when the NO-BAK 29 becomes stopped, then gear 38 is driven clockwise, which causes shaft 49 to engage with clutch 50 and produce a brake-set output.

As another example, consider a failure in the detector itself, for example, between the NO-BAK 29 and the input shaft 22 while raising a load. Since a NO-BAK transmits motion only when powered by the shaft 22, the NO-BAK will lock up upon failure of that drive. The gear 38 will be moved in a clockwise direction, locking up clutch 50 to produce a brake-set.

As another type of failure, consider a failure in the detector itself when raising the load, such as by a failure of shaft 52. As is well known, a worm gear cannot backdrive the screw shaft 52. This locks up the input from the motor side of the differential, and the gear 38 will be driven in a clockwise direction to produce a brake-set signal as soon as the drum is reversed to the lowering mode.

In the case of overspeed in the down or lowering direction (overspeed is not a problem in the raising direction), the clutch 18 will decouple, again stopping the worm gear 51. The drum input will be the direction of arrow 45, causing a clockwise direction of shaft 49, and will set the brake.

Thus, as is readily apparent, the detector does develop a brake-setting output signal in generally all conceivable types of failures or hazard conditions.

The signal or clockwise movement of sprag clutch 50 is uniquely provided to trigger release of the brake in a manner which allows the trigger to be reset without manual intervention. This is an advantage when testing an installed system as well as to reset the brake during inadvertent trips or when the brake has been set intentionally by a failure or by the operator of the hoist. This brake-actuating mechanism is best shown in FIGS. 1, 1A and 2. In the embodiment illustrated, the band brake 24 is connected at its free end to a bell crank 70. This bell crank is connected to a trigger mechanism 72 of a type similar to that shown in U.S. patent application Ser. No. 205,009. The trigger mechanism 72 employs a catch 74 having a cam surface 76 and a lower cam surface 78. A latch 80 has an abutment end 82. The brake is set by a large force-applying compression spring, shown schematically as 84. The brake is retracted or reset by a conventional air bag or cylinder and piston 86. The air bag is such that it is energized to compress the spring 84 and loosen the brake band. The end 82 of the latch 80 engages the cam surface 76. The latch is raised by engagement of a boss 88 on the backside of the catch. The arrangement of the cams 76 and 78 are such that they will try to rotate latch 80 clockwise in a brake-releasing condition, but so long as the latch 80 is held in the upright condition, the catch 74 cannot move. Thus, once latch 80 is held in the raised position, catch 74 cannot move and the air can be vented from the air bags 86. As a typical example, the force by the spring 84 will cause approximately one hundred fifty pounds of force to be required to hold the latch 80 in the raised position. This one hudred fifty-pound force is to be contrasted with the cocking force of several thousand pounds (6,000 lbs., for example) that will be placed in the spring 84 by the air bags as is commonly necessary for setting this type of band brake. The advantage, of course, as with the embodiment in Application Ser. No. 205,009, is that now a very quick acting, small restraining force can be used to trigger or release a much larger brake-applying force.

The upper end of latch 80 is coupled by the cable 27 to a reverse generally C-shaped slide 92. The slide is initially moved into a raised position by a smaller force compression spring 94 of perhaps twenty or thirty pounds force. The slide 92 is carried in a track 95. The slide is held up by a roller 96 which is carried on a wedge ring 98 and fits beneath a top leg **92*a* of the reverse C-shaped slide. The wedge ring is rotated counterclockwise by a reset cable 100, which is coupled to a tension spring 102. Due to the downward pull by cable 27 after the brake is reset, wedges 106 on the wedge ring friction fit into a wedge carrier 107 that is fixed to the sprag clutch 50 in the position shown in solid lines in FIG. 4 (the operational position). In this condition, of course, the output shaft 49 from the differential will either be stationary or rotating in the counterclockwise direction so that the wedge ring freely rotates on the shaft 49**.

When an output signal to set the brake is produced by clockwise rotation of the output shaft 49, the sprag clutch 50 locks up and rotates clockwise. This clockwise rotation of the sprag clutch rotates the wedge ring 98 in the clockwise direction into the phantom line position of FIG. 4. This removes roller 96 from under the leg **29*a* of the slide 92, allowing the one hundred fifty-pound force in cable 27 to be released. Latch 80 is rotated clockwise, releasing catch 74, allowing spring 84** to set the brake.

To reset the brake, air is applied to the air bags 86, moving the catch 74 to the left. The compression spring 94 raises slide 92. The reset spring 102 pulls wedge ring 98 counterclockwise to reset the roller beneath the slide. A finger **98*a* limits clockwise rotation of the wedge ring. The finger also engages the lowered slide and prevents the wedge ring 98 from being returned to its normal position prior to the slide 92 being raised again to its normal position. Wedge ring 98 is slightly oversized on its shaft such that its wedges 106 release from the wedge carrier 107 when the downward load, caused by cable 27, is released from the wedge ring. This allows the wedge ring to be rotated into its reset condition or a counterclockwise direction. The resetting of the slide 92 and the wedge ring occurs prior to the time the air bags have retracted catch 74 to its further left reset position. Thus the wedge ring remains free on clutch 50 until the latch 80 is caused to rotate slightly clockwise by the spring 84 after the air bags have been vented. Then the one hundred fifty-pound force is again applied to the slide to hold the wedge ring tight against the carrier and thus the sprag clutch 50**.

To summarize the operation of the trigger mechanism 72 and slide 92 assume the brake 24 has been engaged to stop the drum. Spring 94 will raise slide 92, spring 102 will pull cable 100 to swing wedge ring counterclockwise as viewed in FIG. 4 to push roller 96 under leg **92*a* of the slide. The slide is now held against downward movement. When the trigger is recocked, brake 24 is released from the drum, large force spring 84 is compressed, catch 74 is moved to the left in FIG. 1A and hooks over 78. Abutment end 82 is reengaged by cam 76 and the angle of the force vector from cam 76 to abutment 82 is above the pivot of latch 80 so that when air is released, the spring 84 moves the catch 74 slightly to the right causing latch 80 to swing clockwise in FIG. 1A and apply tension in cable 27. The tension in cable 27 pulls slide 92 downwardly against roller 96. This pulls wedge ring 98 downwardly forcing wedges 106 into carrier 107**.

When the wedge ring is rotated to release the trigger mechanism and engage the brake, the roller is moved out from under leg **92*a* of the slide 92. The slide is pulled down by cable 27. Cable 27 now moves down, allowing latch 80 to swing clockwise clear of cam surface 76. Catch 74 is released and moves to the right to allow spring 84 to set the brake 24**.

Figure 7:
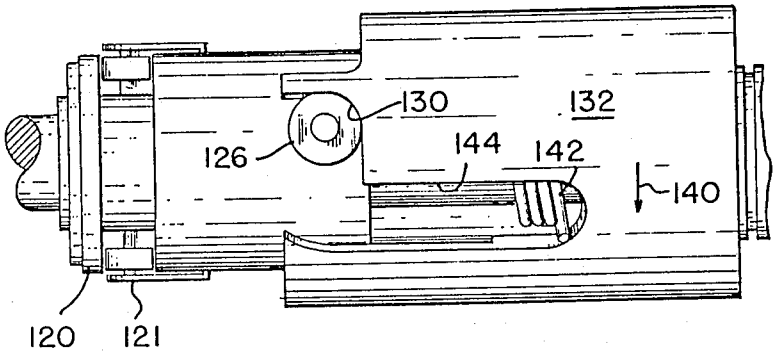
FIG. 7 is a fragmentary plan of the device shown in FIG. 6.
Figure 6:
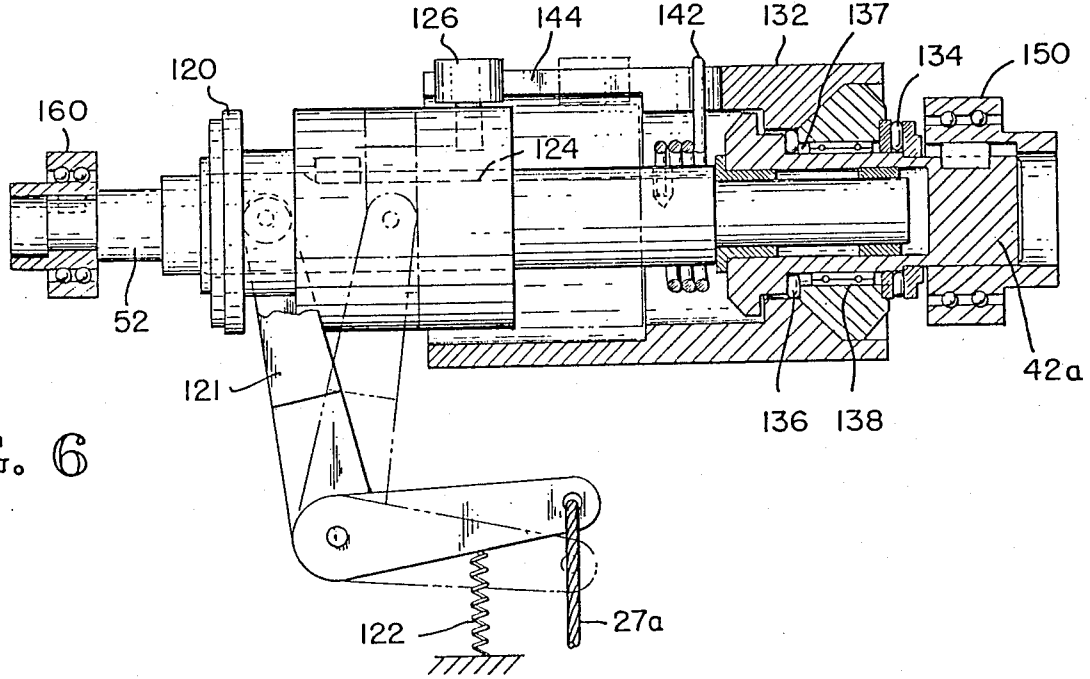
FIG. 6 is a schematic fragmentary side elevation of another embodiment of a detector embodying the principles of the invention.

FIGS. 6 and 7 illustrate a simplified embodiment usable with or without a slip correction device 54. Assuming the slip correction device is employed, the differential detector of FIG. 6 employs an equivalent motor input shaft 52*a* from the motor and an equivalent hollow input shaft 42*a* from the drum. If the slip correction device is not employed, then the motor input shaft would be equivalent to shaft 14. A collar 120 is pivotally connected to a bell crank 121. A spring 122 holds the bell crank in a counterclockwise direction and is equivalent to the spring 94 of FIG. 4. Cable 27*a* is attached to the right-hand end of the bell crank. The collar 120 is keyed within an axial slot 124 in the shaft 52*a*. A roller 126 is rotatably mounted on the collar. The roller is held against a cam surface 130 which forms part of a cam block 132. The cam block is joined to shaft 42*a* by a friction clutch 133 and a one-way clutch 138, positioned by needle thrust bearings 134 and radial bearings 137. The cam block freewheels on the shaft 42*a* in one direction of rotation, but is joined to the shaft 42*a* in locked arrangement by the one-way sprag clutch 138 and friction clutch 133. The cam block moves with the shaft 14 or 52*a* and is held in the direction of the arrow 140 by a coil spring 142. The cable 27*a* produces approximately a one hundred fifty-pound pull on the collar, urging it axially to the right in FIG. 6, energizing the friction clutch 133. It can be seen that as the cam block 132 is moved in the direction opposite to the arrow 140, the roller moves off the cam surface 130 and is pulled by the force in cable 27*a* in a slot 144. This allows the bell crank to rotate clockwise, releasing the trigger to set the brake in the manner shown for the embodiment of FIGS. 1–5. The friction clutch is also de-energized, allowing cam block 132 to freely rotate with shaft 52*a*. Resetting of the brake is essentially the same as in the preferred embodiment, with the spring 122 moving the collar back to the left. This movement withdraws the roller 126 from the slot 144 and allows spring 142 to reset the cam block in the direction of the arrow 140. The roller 126 then is precluded from moving to the right in FIG. 6, which then holds the bell crank in a fixed position when the one hundred fifty-pound load is again placed on the cable 27*a* by the trigger mechanism.

In the embodiment of FIGS. 6 and 7, as in the earlier embodiment, the device senses a differential movement between the shaft 42*a* and the shaft 14 or 52*a* in a predetermined direction to cause the sprag clutch 138 to rotate clockwise in the embodiment illustrated to rotate the cam block and release the collar 120. The normal operating rotations will produce either a zero differential rotation between shafts 52*a* or 14 and 42*a*, if there are perfectly matched gear reductions between the motor and drum and the detector and if there is no relative slippage in the drive trains. If these conditions do not exist, then a unidirectional rotational differential exists. In either case, a failure or hazard condition will cause an output rotation in a predetermined direction and opposite said unidirectional rotation, if such is in effect, to set the safety brake.

Various examples of operation of the embodiment of FIGS. 6 and 7 will now be explained. In a first example, assuming the motor input shaft 52*a* is turning clockwise and the drum input shaft 42*a* is also turning clockwise, but because of the slip correction, the shaft 42*a* will be traveling clockwise slower than will shaft 52*a*. In this condition, the sprage clutch 138 is freewheeling. The shaft 42*a* runs slower because we are assuming that the slip correction device is being employed and thus the shaft 52*a* is equivalent to shaft 52*a* of FIG. 5. There are also provided a NO-BAK 150 locking shaft 42*a* to the frame and a NO-BAK 160 locking shaft 52 to the frame. Thus NO-BAK 150 will allow shaft 42*a* to drive clockwise or counterclockwise, but will not allow shaft 42*a* to be driven by shaft 52*a*. Similarly, NO-BAK 160 will allow shaft 14 or 52*a* to be driven from the motor but will not allow shaft 14 or 52*a* to backdrive through NO-BAK 160. Now assume that the motor shaft fails, creating a failure condition. NO-BAK 160 locks shaft 52*a*, shaft 42*a* thus turns clockwise faster than shaft 52*a*, clutch 138 engages, and the cam block 132 gets rotated clockwise, causing roller 126 to enter slot 144 and set the brake.

As a second example, consider raising the load, with the motor input shaft 52*a* turning counterclockwise and the drum shaft 42*a* turning counterclockwise. The slip correction device, however, will cause the shaft 42*a* to rotate faster than shaft 52*a* in the counterclockwise direction such that the sprag clutch still freewheels. Again assume that there is a discontinuity in the main drive between the motor and the drum. Shaft 52*a* will lock up. The drum, since it was raising a load until the drive failure, will immediately reverse direction and begin to lower the load. Thus the shaft 42*a* will reverse to a clockwise direction, causing the cam block 132 to move clockwise and set the brake.

A further advantage is that whenever the operational brake is set, any slippage or failure in the operational brake will also be detected and set the safety brake. This overcomes a major problem in hoists because the brakes can otherwise wear severely without detection by the operator and allow the load to slip.

As another example, assume a two-blocking hazard during raising. Shaft 52*a* will be turning counterclockwise; shaft 42 will be turning counterclockwise. Shaft 42 will stop when the cable sheaves become two-blocked ("two-blocking" occurs when the traveling blocks engage the stationary blocks). Since shaft 42*a* is stopped and the shaft 52 continues to turn counterclockwise, the roller 126 moves off the cam surface 130 into the slot and sets the brake.

While the preferred embodiments of the invention have been illustrated and described, it should be understood that variations will be apparent to one skilled in the art without departing from the principles herein. Accordingly, the invention is not to be limited to the specific embodiments illustrated in the drawings.

We claim:

1. A safety system in a hoist having a motor with a motor shaft, a power transmission main drive, said system having an error between the relative rotations of the drum and the motor shaft, a drum, and a safety brake drivingly coupled on an operating element operatively connected to the drum, comprising:

a mechanical out-of-sync detector, a safety brake actuator responsive to an output from the out-of-sync detector for applying said safety brake, said detector including a monitoring secondary drive train having a first input shaft drivingly coupled to said motor, a second input shaft drivingly coupled to said drum, means for detecting a predetermined variation in relative speed or direction between said two shafts and producing a unidirectional brake-setting rotational output, and correction means for producing a predetermined, limited, differential rotational direction and velocity between said first and second input shafts to generate a unidirectional rotational output in a predetermined direction opposite said unidirectional brake-setting rotational output greater than said relative rotation error for compensating for such relative rotation error.

2. The safety system of claim 1, said detector including a differential assembly having meshing differential gears and a differential carrier, one of said input shafts drivingly coupled to the differential assembly, another of said input shafts being coupled to the differential assembly, a brake-actuating output shaft being drivingly coupled to said differential assembly, whereby said input shafts produce said rotations in said brake-actuating output shaft, and one-way clutch means coupling said brake-actuating output shaft to said safety brake actuator only when said output shaft rotates in said unidirectional brake-setting output rotational direction.

3. The safety system of claim 1, said detector including coaxially aligned first and second input shafts drivingly coupled to said drum and motor shaft, an axially movable collar on said first input shaft movable between a safety brake-set position and a safety brake-off position, linkage means coupling said collar to said safety brake actuator, stop means on said second input shaft and operative in one unidirectional differential rotation between said input shafts to hold said collar in said brake-off position but in the opposite differential direction of rotation, releasing said collar to move into said brake-set position and cause the linkage means to produce said output to trigger the brake actuator and set the safety brake.

4. The safety system of claim 2, said input shafts each provided with unidirectional power transmission means for passing bidirectional rotation into the detector but blocking rotation back out through the input shafts from the detector.

5. The safety system of claim 2, said brake actuator including a unidirectional, rotation transmitting, one-way clutch on said brake-actuating output shaft, a wedge ring releasably, drivingly coupled to said one-way clutch, means biasing said ring in a brake-hold position, said brake including trigger means having a latch and a catch, said catch having a large force biasing the catch into a brake-set position, said latch having releasable locking means having sufficient leverage for holding said catch against said large force by a small force when in a brake-off position but movable upon release of said small force to release said catch to move into its large force brake-set position, said wedge ring including brake-trigger holding means, and linkage means coupling said latch to said wedge ring brake-trigger holding means for holding said latch in said brake-off position, and wherein rotation of said detector output shaft in said unidirectional brake-setting output rotation rotates said wedge ring to release said linkage means and set the safety brake.

6. The system of claim 5, said linkage means including spring means for resetting said brake-trigger holding means to hold the trigger means in a brake-off-holding position.

7. The system of claim 6, said wedge ring including wedges which lock to said one-way clutch when subjected to a pull by said linkage means but releasing from said one-way clutch for allowing free rotational resetting of the wedge ring when said linkage means pull is withdrawn.

8. The system of claim 1, said error being a variation in speed reductions in the main drive train between the motor shaft and the drum and the motor shaft, drum and detector, said correction means including means for producing said second unidirectional rotation in the output in excess of such speed reduction variation.

9. The system of claim 1, said main drive train having a member which will cause rotational slippage error between the drum and the motor shaft, said correction means producing said second unidirectional rotation in the output in excess of such rotational slippage error.

10. The system of claim 8 or 9, said correction means including a speed-increasing gear set between said first and second input shafts and a speed -reducing gear set between said first and second input shafts, slip clutch means coupling one of the gear sets to said first input shaft, one-way clutch means coupling the other of said gear sets to said first input shaft for producing a slower rotational speed in the first input shaft relative to the second input shaft in one direction of rotation and producing a faster rotational speed in the first input shaft relative to the second input shaft in the opposite rotational direction.

11. The system of claim 1, including clutch means responsive to overspeed for decoupling one of said input shafts when said motor or drum rotates overspeed a predetermined amount, causing a variation of said output for producing said unidirectional brake-setting output.

12. A safety system in a hoist having an input motor, a power transmission main drive train, a drum, a safety brake operatively coupled to the drum, comprising:

a mechanical out-of-sync detector, a safety brake actuator responsive to an output from the out-of-sync detector for applying said safety brake, said detector having a first input shaft drivingly coupled to said motor, a second input shaft axially aligned with said first input shaft and drivingly coupled to said drum, said input shafts having rotational velocities and directions, mechanical linkage means coupled to one of said shafts to produce an output to said brake actuator for applying said safety brake, and release means between the input shafts sensing a change in the angular position of one input shaft relative to the other input shaft in one predetermined direction only for releasing said linkage means and producing said output to set the safety brake, said release means being unresponsive to a change in angular position of one input shaft relative to the other input shaft in a direction opposite said one predetermined direction.

13. The safety system of claim 12, said main drive train having a member which will cause limited rotational slippage error between the relative angular positions of said drum and the motor, and including slip correction means for producing an additional relative angular position change in one of said input shafts in excess of said slippage error and in a direction opposite said predetermined direction for canceling the accumulative effects of said slippage error from the detector.

14. The safety system of claim 12, said system having a deviation from exact speed reductions between the motor shaft and the drum and the motor shaft, drum and detector, and including deviation correction means producing an additional rotation in one of said input shafts in excess of and in a direction opposite said deviation.

15. The safety system of claim 13 or 14, said correction means including a speed-increasing gear set between said first and second input shafts and a speed-reducing gear set between said first and second input shafts, slip clutch means coupling one of the gear sets to said first input shaft, one-way clutch means coupling the other of said gear sets to said first input shaft for producing a slower rotational speed in the first input shaft relative to the second input shaft in one direction of rotation and producing a faster rotational speed in the first input shaft relative to the second input shaft in the opposite rotational direction.

16. A safety system in a hoist having an input motor, a gear reduction unit, a drum, a safety brake drivingly operatively coupled to the drum, comprising:

a mechanical out-of-sync detector, a safety brake actuator responsive to an output from the out-of-sync detector for applying said safety brake, said detector including a mechanical differential having a first input shaft drivingly coupled to said motor, a second input shaft drivingly coupled to said drum, a brake actuator output shaft, a differential gear set coupled to said first and second input shafts and operable upon relative angular velocity changes between said input shafts in a predetermined direction and amount to rotate said output shaft in an out-of-sync condition, and means operatively coupling the output shaft to said safety brake actuator for applying the brake in said out-of-sync condition, said means coupling the output shaft to the safety brake actuator including a wedge ring, one-way clutch means allowing said wedge ring to remain stationary in a brake-open position during one direction of rotation of said output shaft but operable to rotate into a brake-set position during rotation in the opposite brake-setting direction of said output shaft, and linkage means coupled to said wedge ring for triggering the safety brake actuator to set the brake in response to said brake-setting rotation of said output shaft, and means releasing said wedge ring for free rotation on said one-way clutch means when said brake is set.

17. The system of claim 16, said linkage means including a cable having one end coupled to said safety brake actuator, a slide member coupled to the other end of said cable, said wedge ring including slide-holding means for holding the slide member against a pull by said cable, wherein said rotation of said wedge ring releases said slide member to set the brake, and means for resetting said slide member and wedge ring into said brake-open position.

18. A safety system in a hoist having a motor, a drum, a gear reduction unit coupling the motor to the drum, and a safety brake operatively coupled to the drum, the improvement comprising:

a safety brake actuator for setting said safety brake, an out-of-sync detector having an output for triggering said brake actuator to set the brake, said out-of-sync detector including a first input shaft operatively coupled to the motor and a second input shaft operatively coupled to the drum, means for detecting a change in the angular position of one input shaft relative to the other input shaft in one predetermined direction only for producing said output, said detecting means being unresponsive to a change in the relative angular position of said input shafts in a direction opposite said one predetermined direction and not producing said output, and means coupling the safety brake actuator to the detector for transmitting said output to said safety brake actuator for engaging the brake.

19. The system of claim 18, said change in angular position detecting means including a differential assembly driven by said first and second input shafts and having an output shaft whose direction is dependent upon the relative rotation of said input shafts, and means joining said output shaft to said safety brake actuator for setting the brake responsive to said detected change in angular position in said one predetermined direction.

20. A method of detecting a failure or hazard condition in a hoisting machine of the type having a motor, a motor shaft driving a power transmission main drive train and thence a drum, and wherein rotational deviations between the motor shaft and drum can occur, and wherein a safety brake is provided operatively coupled to the drum to stop the drum upon detection of a failure or hazard, comprising:

monitoring the rotational speed and direction of the motor, monitoring the rotational speed and direction of the drum, introducing a deviation correction rotation velocity component to one of said monitored speeds and directions to produce a first unidirectional relative rotation therebetween in excess of the rotational deviation, such hazard or failure condition producing a large differential in relative speed or direction between said monitored speeds and directions, detecting such large differential between the monitored speeds and directions in said hazard or failure condition, and producing a second unidirectional rotation opposite said first unidirectional rotation, and triggering the safety brake in response to such detected second unidirectional rotation.

21. The method of claim 20, said main drive train having a device that causes slippage between the relative rotations of said monitored speeds and directions, said deviation correction velocity component being an amount exceeding the rotation differential caused by slippage of the device.

22. A safety system in a load-carrying hoist in which there is defined a last high-speed load-carrying component and a last low-speed load-carrying component and a drive motor with a motor shaft, a power transmission main drive operatively connected to the motor, an operating brake operatively associated with the motor to hold the load when the motor is de-energized, a drum, and an emergency safety brake operatively coupled to the drum but independent of the main drive so as to provide emergency holding of the load in the event of a main drive failure, a safety brake actuator responsive to an output from an out-of-sync detector for applying said safety brake, comprising a mechanical out-of-sync detector, said detector including a monitoring secondary drive train having a first input shaft drivingly coupled to the last high-speed load-carrying component, a second input shaft drivingly coupled to the drum, means for detecting a change in the angular position of one input shaft relative to the other input shaft in one predetermined direction only and producing an emergency brake-setting rotation output to set said emergency safety brake, wherein said emergency safety-brake-setting rotation output is always unidirectional, said detecting means being unresponsive to a change in the relative angular position of said input shafts in a direction opposite said one predetermined direction and not producing said unidirectional emergency safety-brake-setting rotation output.

23. The system of claim 22, wherein said power transmission main drive has minor slippage producing an accumulative error between the relative rotations of the last high-speed and last low-speed load-carrying components, error compensating means for producing a predetermined, limited, differential rotational direction and velocity between said first and second input shafts to generate a unidirectional rotational output in a direction opposite said predetermined direction and of a velocity greater than said slippage producing accumulative error for compensating for such accumulative error.

24. The safety system of claim 22, said out-of-sync detector including a differential assembly having meshing differential gears and a differential carrier, one of said input shafts drivingly coupled to one of the differential gears, another of said input shafts being coupled to another of the differential gears, an emergency safety brake-actuating output shaft being drivingly coupled from said differential assembly, whereby said input shafts produce said rotations in said emergency safety-brake-actuating output shaft, and oneway clutch means drivingly coupling said emergency brake-actuating output shaft to said emergency safety brake actuator only when said output shaft rotates in said unidirectional emergency safety brake-setting output rotational direction.

25. The safety system of claim 22, said detector including coaxially aligned first and second input shafts drivingly coupled to said last high speed and last downstream load-carrying component and the drum, an axially movable collar on said first input shaft movable between an emergency safety brake-set position and an emergency brake-off position, linkage means coupling said collar to said safety brake actuator, stop means on said second input shaft and operative in one unidirectional differential rotation between said input shafts to hold said collar in said brake-off position but in the opposite differential direction of rotation, releasing said collar to move into said emergency safety brake-set position and cause the linkage means to produce said emergency safety brake-setting rotation output to trigger the brake actuator and set the safety brake.

26. A safety system in a hoist having a motor with a motor shaft, a power transmission main drive, a drum, and a safety brake drivingly coupled on an operating element to the drum, said system having an accumulative angular error produced between the relative angular position of the drum and the motor shaft, comprising:

a mechanical out-of-sync detector, a safety brake actuator responsive to an output from the out-of-sync detector for applying said safety brake, said detector including a monitoring secondary drive train having a first input shaft drivingly coupled to said motor, a second input shaft drivingly coupled to said drum, means for sensing a change in the angular position of one input shaft relative the other input shaft in one predetermined direction only and producing a brake-setting rotational output, and correction means for producing a predetermined, limited change in the angular position of said one input shaft relative to the other input shaft in a direction opposite said one predetermined direction in an amount greater than said accumulative angular error for compensating for such relative angular accumulative error.

27. The safety system of claim 26, said correction means including a speed-increasing gear set between said first and second input shafts and a speed-reducing gear set between said first and second input shafts, slip clutch means coupling one of the gear sets to said first input shaft, one-way clutch means coupling the other of said gear sets to said first input shaft for producing a slower rotational speed in the first input shaft relative to the second input shaft in one direction of rotation and producing a faster rotational speed in the first input shaft relative to the second input shaft in the opposite rotational direction.

* * * * *